United States Patent [19]

Bortner

[11] 4,068,835

[45] Jan. 17, 1978

[54] APPARATUS FOR ASSEMBLING TAKE-ONE ADVERTISING DISPLAYS

[75] Inventor: Allen A. Bortner, Searingtown, N.Y.

[73] Assignee: Charles Offset Company, Inc., New York, N.Y.

[21] Appl. No.: 714,993

[22] Filed: Aug. 16, 1976

[51] Int. Cl.[2] ..... B42B 2/00

[52] U.S. Cl. ..... 270/53; 93/93 R; 270/59

[58] Field of Search ..... 270/59, 37–38, 270/53, 58; 227/45, 48, 50, 3, 7, 100; 93/93 R, 93 C, 93 DP

[56] References Cited

U.S. PATENT DOCUMENTS

| | | | |
|---|---|---|---|
| 2,666,638 | 1/1954 | Taylor | 270/58 |
| 3,630,513 | 12/1971 | Davidson | 270/53 |
| 3,979,112 | 9/1976 | Munn | 270/58 |

*Primary Examiner*—E. H. Eickholt
*Assistant Examiner*—A. Heinz
*Attorney, Agent, or Firm*—Brumbaugh, Graves, Donohue & Raymond

[57] ABSTRACT

An automated machine for assembling a "take-one" advertising display, which display consists of an advertising panel with a pack of advertising coupons stapled to it, has a panel feeder that takes one panel at a time from a stack of panels and locates them on a conveyor system. Each panel is successively positioned in a coupon insertion station by the conveyor. Packs of coupons are separated from a stack by a wedge-shaped blade and are carried to the panel in the station by mechanical arms. A staple gun secures the coupons to the panels to form a completed take-one display.

8 Claims, 5 Drawing Figures

ADVERTISEMENT SPACE
COUPON
10
11
12
13
14
15
18
22
23
24
4
38
39
60
61
62
63
64
66
67
68
69
70
71
72
73
74
76
77
78

APPARATUS FOR ASSEMBLING TAKE-ONE ADVERTISING DISPLAYS

BACKGROUND OF THE INVENTION

This invention relates to advertising materials and, more particularly, to apparatus for the manufacture of "take-one" advertising displays.

A take-one advertising display generally consists of a cardboard panel, upon which suitable advertising matter is printed, and a collection of coupons, pictures or calendars commonly referred to as a pad, which is stapled to the panel. Generally, individuals are invited by the printed message to tear off one or more of the coupons and, therefore, the coupons are connected to the cardboard panel in such a way as to permit ready removal of one coupon at a time.

The assembling of the preprinted and preformed cardboard panels with printed coupon pads has heretofore been done by hand. This has required that packs of a predetermined number of coupons be seperately bound to form a pad prior to being stapled to the panel. Such binding has been accomplished through the manual application of a small quantity of glue along one edge of the pack of coupons.

The preliminary formation of the pads, coupled with manual assembly of panels and pads is costly, both in terms of materials and labor, and is relatively slow, thereby adding to the overall cost and decreasing the attractiveness of take-one displays as an advertising tool.

SUMMARY OF THE INVENTION

The present invention is directed to apparatus for automatically assembling the cardboard panels and coupons of a take-one advertising display at a high rate of speed, which apparatus eliminates the preliminary pad formation required with manual assembly.

In an illustrative embodiment of the invention, means are provided for moving the panels to a predetermined position one at a time. A preselected number of coupons is then separated from a stack and driven toward a movable gate. The pack of selected coupons is engaged by a movable surface located beneath a set of mechanical arms and the movable gate opens so the pack of coupons can be pushed to the cardboard panel. When the panel is in place, portions of the mechanical arms are pivoted downwardly against the pack to hold it while it is stapled to the panel. During this operation the blade is removed from the stack and assumes its original position while the stack of coupons is allowed to rest on a smooth surface on the top of a nonpivoted portion of each of the mechanical arms. As soon as the staples have been inserted, the mechanical arms release the pack of coupons and return to their original position, causing the stack of coupons to fall off the top of the mechanical arms onto a support plate. Then, the moving gate closes, the assembled panel moves on and a new panel is located in the proper position for the installation of a pack of coupons.

BRIEF DECRIPTION OF THE DRAWINGS

The foregoing and other features of the present invention will be more readily apparent from the following detailed description and drawings of an illustrative embodiment of the invention in which.

DESCRIPTION OF A PREFERRED EMBODIMENT

Figures 1, 2:
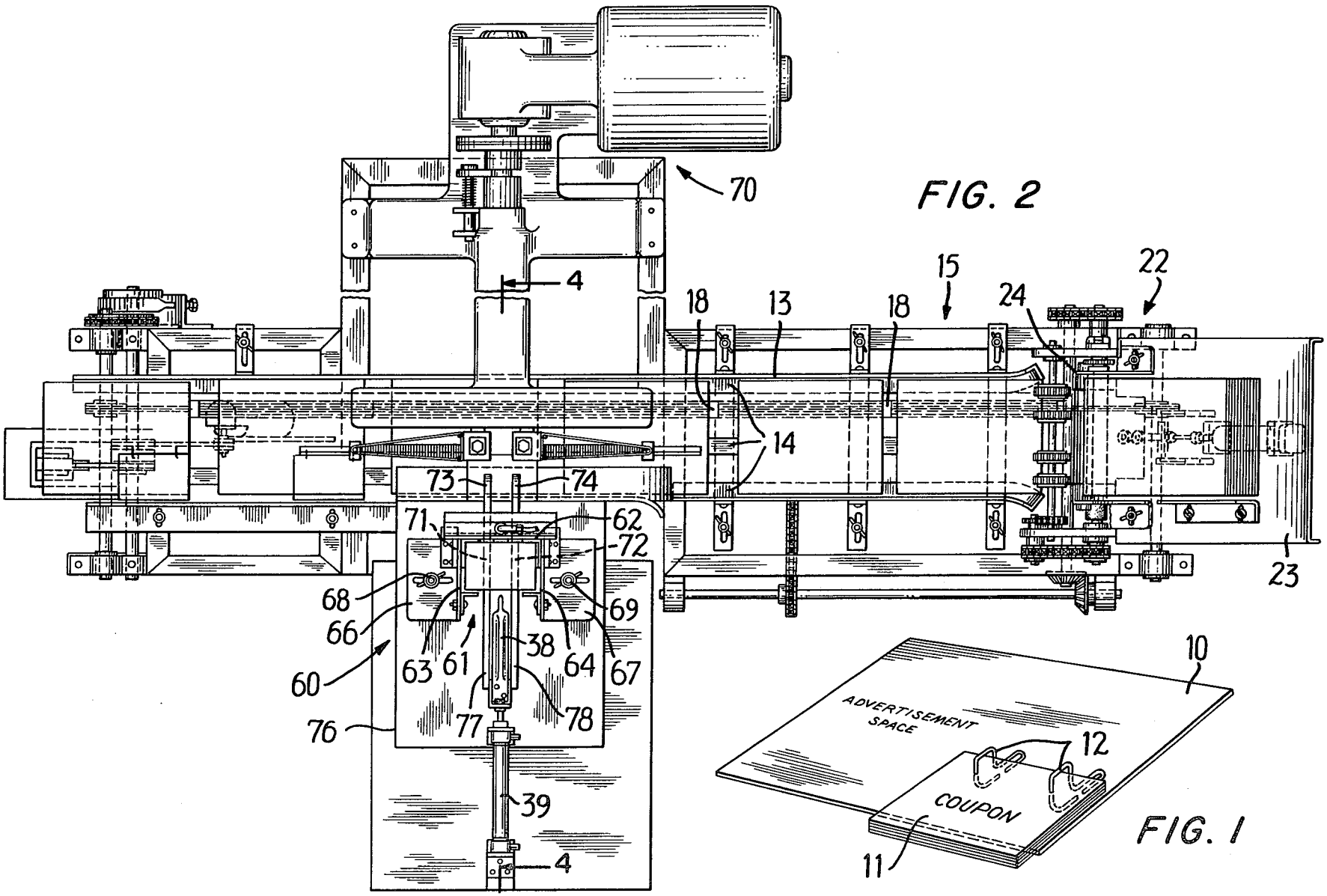
FIG. 1 is a perspective view of a take-one advertising display.
FIG. 2 is a top view of an illustrative embodiment of the invention capable of assembling the display of FIG. 1.

Referring now to the drawings, and in particular to FIG. 1, there is shown an assembled "take-one" advertising display which includes a preformed advertising panel 10 to which is fastened a stack or pad 11 of "take-one" coupons. The combination of panel 10 and coupon apd 11 is preferably fastened with staples 12 of the type disclosed in the present inventor's prior U.S. Pat. No. 2,906,547.

Figure 3:
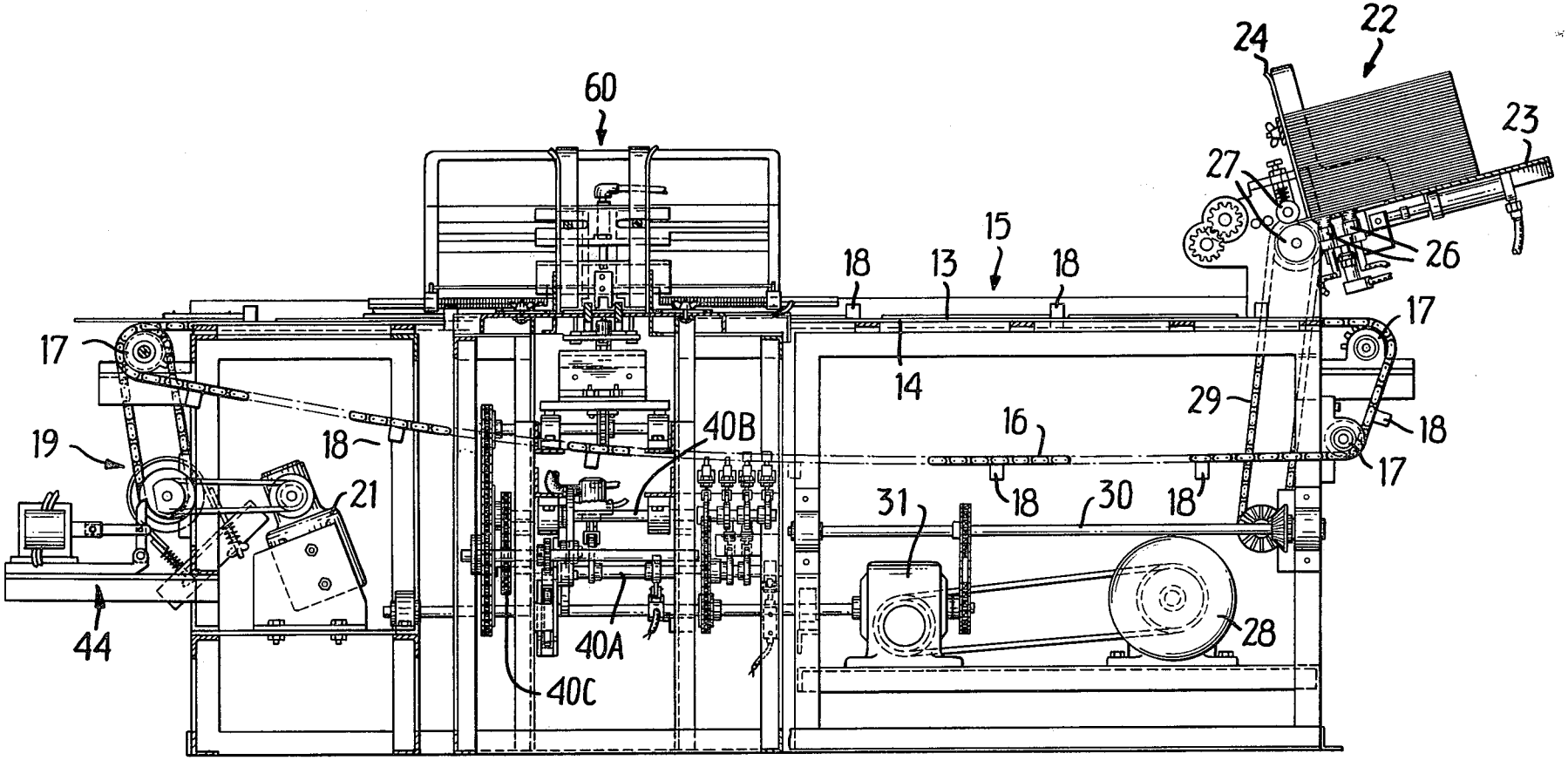
FIG. 3 is a front view of the apparatus of FIG. 2.
Figure 4:
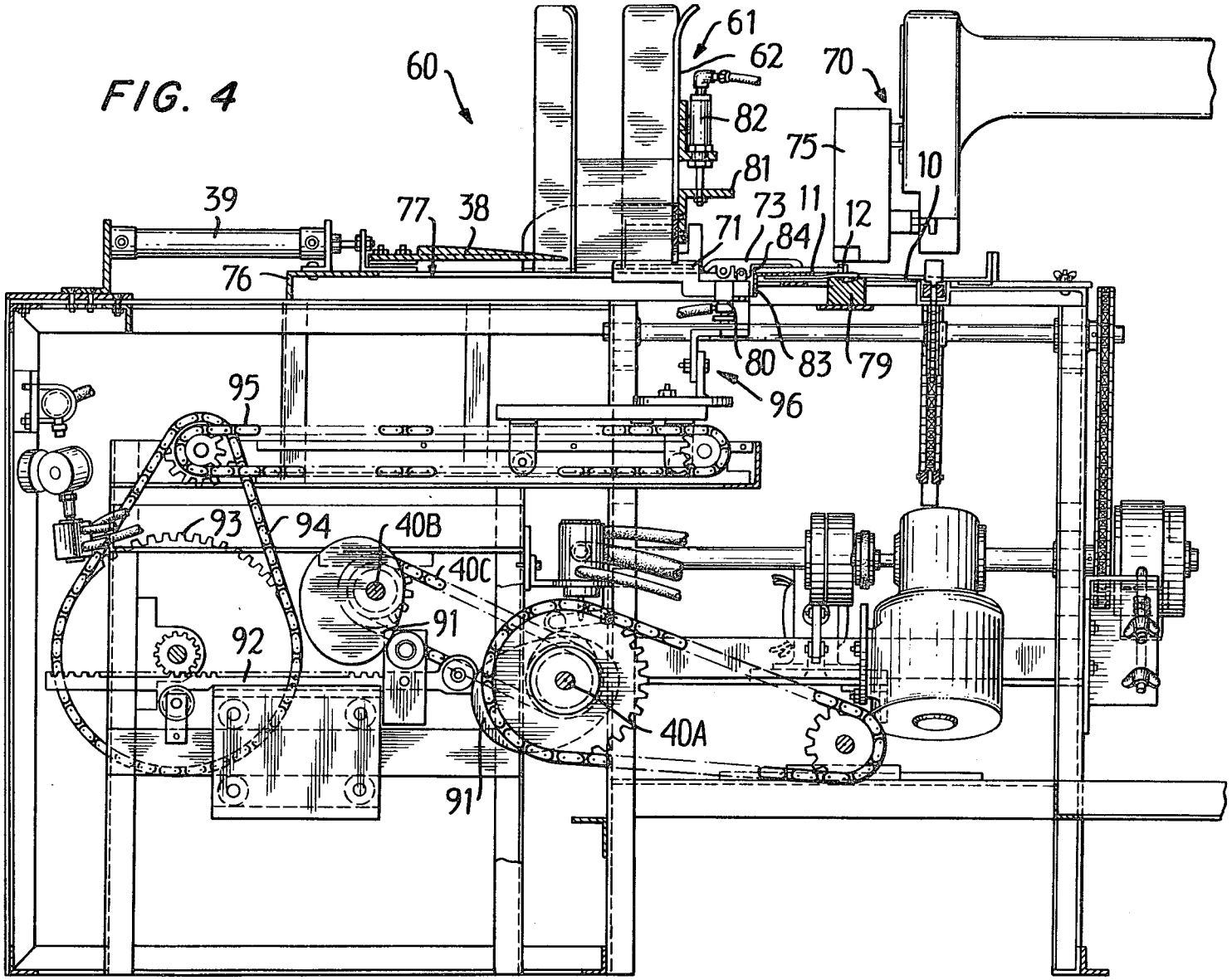
FIG. 4 is an enlarged side sectional view of the apparatus of FIG. 2 along line 4—4.

As best shown in the top view of FIG. 2, the apparatus of the present invention includes a panel feeding mechanism 22, a conveyor system 15, a coupon insertion station 60 and a staple gun 70. Prior to operation, the panel feeding mechanism 22 is provided with a stack of panels (FIG. 3) and the coupon insertion station 60 is provided with a stack of coupons (FIG. 4). The stack of coupons need not be grouped in preset numbers and glued together as is required in the prior art manual method of making take-one displays.

When the apparatus is started the panel feeding mechanism 22 ejects one panel at a time from the stack onto the conveyor system 15 which carries the panels to the coupon insertion station 60 and the staple gun 70. The coupon station and the gun are located at one point opposite each other across the conveyor system 15. As a panel reaches the coupon station, the conveyor halts its motion. Next the coupon station automatically separates a preset number of coupons from the stack and carries them to the proper position over the panel. At this point the staple gun fixes the present number of coupons to the panel. The conveyor system then moves the completed take-one display out of the coupon insertion station and moves a new unfinished panel into the station. This process is repeated for each panel.

A more detailed description of the apparatus will now be given with reference to FIGS. 2 and 3, which show the substantially horizontal conveyor system is provided with an elongated horizontal track 13 comprised of several parallel support frames 14 having low friction upper surfaces. An endless flight belt or chain is mounted beneath the frames 14 so that an upper protion of it is coextensive with and closely adjacent the length of the conveyor. A plurality of pulleys and sprockets 17 are suitably positioned to provide the requisite shape and positioning for the flight chain.

The flight chain is provided with several outwardly extending lugs 18. As shown in FIG. 2, the lugs are sufficiently spaced apart to permit one preprinted panel to fit between them. Enough lugs are provided so that individual panels can be moved continuously and successively in one direction along the length of the track.

Power for driving the chain 16 is provided by a conveyor motor 21. The endless chain 16 is connected to the motor through a series of appropriate mechanical linkages, generally indicated by reference numeral 19.

The panels are fed to the conveyor 13 by the feeding mechanism 22. The operation of the feeder is best understood with particular reference to FIG. 3. The mechanism 22 is comprised of a support platform 23 on which a plurality of preprinted or preformed panels are stacked. There is also provided a front plate 24 which is substantially perpendicular to the platform 23. The purpose of the plate 24 is to insure proper edgewise alignment of the stack of panels. The panels are stripped from the bottom of the stack by vacuum cups or suckers 26. As the bottom panel is pulled away from the stack it is engaged by nip rollers 27 which direct it outwardly away from the stack and toward the conveyor track. Power for the feeding mechanism 22 is supplied by a main motor 28 connected to the nip rollers by means or appropriate linkages including, for example, a drive belt 29 extending upwardly from a secondary motor drive shaft 30, which in turn is driven by a gear system 31 connected to motor 28. It will be understood that other mechanized panel feeding systems may be utilized by those who wish to practice the invention without departing from its scope.

Once a panel has been ejected onto the conveyor track it is caught by one of the extending lugs 18 of chain 16. The panels are incrementally moved along the horizontal track in distances equal to the spacing between successive lugs 18, from the feeding station 22 towards coupon insertion station 60, and, as will be explained more fully below, the operations of all of the stations of the system are synchronized with this movement. As each panel reaches the insertion station the chain is stopped so that the panel comes to rest at the station. Then part of the mechanism at the coupon insertion station separates a certain number of coupons from a stack, locates them over the panel and staples them in place. Once this operation has been completed the chain begins to move again. The completed "take-one" advertising panel is moved onto the next operation, e.g. packaging, and a new unfinished panel is moved into the coupon insertion station.

Control over the operation of the conveyor system may be accomplished in several ways. One essentially mechanical type of control is illustrated schematically in FIG. 5. The main motor 28 continuously turns a cam shaft 40. In order to save space the shaft 40 is designed as two parallel shafts 40A and 40B which are connected together, for example by chain 40C. A plurality of cams of different shapes, for purposes to be described below, are mounted on the shafts 40A and 40B for rotation therewith. One such cam, indicated by reference numeral 41 is in continuous engagement with a cam follower 42. The follower is electrically connected to a suitable switching solenoid 43 which in turn controls the electrical circuit for a clutching mechanism generally indicated by reference numeral 44. The arrangement of the cam 41 is such that the switch 43, through actuation by the cam follower 42, periodically activates the clutching mechanism 44 to interrupt the movement of the flight chain 16 which is normally driven by conveyor motor 21 (see FIG. 3 also). In this way the movement of the panels 10 is halted when each has reached the proper position for insertion and stapling of the individual coupon pads.

It should be noted that the feed mechanism 22 for the panels may also be controlled by one or more cams, such as the cam 46, mounted on the shaft 40A. In this case, the cam 46 cooperates with its follower 47 to control the operation of a pneumatic valve 48. The valve 48 is connected to a vacuum air supply 49 so as to periodically activate the vacuum cups or suckers 26 of the feed mechanism. Other cams, turned by the shafts 40A and 40B may be connected in similar ways to control other aspects of the feed mechanism. In particular cam 50 moves cam follower 52 so as to actuate pneumatic valve 54. The opening of valve 54 allows air from high pressure air supply 32 to pass through reduction valve 34 to pneumatic cylinder 36 of the feed mechanism. A piston rod in cylinder 36 is connected to the assembly for the suckers 26 and causes it and the attached panel to move toward nip rollers 27. Likewise cam 51 causes cam follower 53 to actuate pneumation valve 55. This allows air pressure from valve 34 to pass to pneumatic cylinder 33, which also connected to the assembly for the suckers 26. A piston rod in cylinder 33 acts to move the suckers into and out of contact with the panels.

Referring now to FIGS. 2 and 4, the "take-one" coupon insertion station is indicated generally by reference numeral 60. The coupon insertion mechanism has a generally three-sided adjustable coupon holder 61. The major front wall 62 of the holder is fixed while the two opposite sides 63 and 64 are adapted to be movable back and forth with respect to the center of the holder. Slotted leg mountings 66 and 67 may be integrally attached to the movable walls 63 and 64, respectively. The use of wing nuts 68 and 69 is representative of the various techniques available for effecting the adjustment and fixation of the holder walls. The purpose of providing an adjustable holder is to provide a capability for accomodating coupons of different sizes.

A pair of carriage arms 71 and 72 traverse the holder 61 at its bottom in the direction of the conveyor. Each of the arms 71 and 72 is drivably connected to one of a matched pair of rocker arms 73 and 74, respectively. The upper surfaces of the carriage and rockers arms are low friction and coplanar. The arms are tracked to ride back and forth near the bottom of the coupon holder. For this purpose, an upper planar frame member 76 which supports the coupon holder 61 may be provided with parallel slots 77 and 78 through which the arms protrude. The assembly of carriage arms and rocker arms is attached to a support frame 96 that is moved by main motor 28. This motor turns shafts 40A and 40B which have cams 91 connected to them. The cams 91 in turn contact a rack 92. As the rack moves back and forth under the influence of the cams, it rotates a gear wheel 93 in first one direction and then the other. This motion in turn is transmitted via a chain 94 to a second chain 95 on which the support frame 96 is attached.

The rocker arms of the assembly can be pivoted about their support by means of a pneumatic cylinder 80. Cylinder 80 is actuated by means of a pneumatic switching arrangement 56 associated with cam shaft 40B (see FIG. 5).

Figure 5:
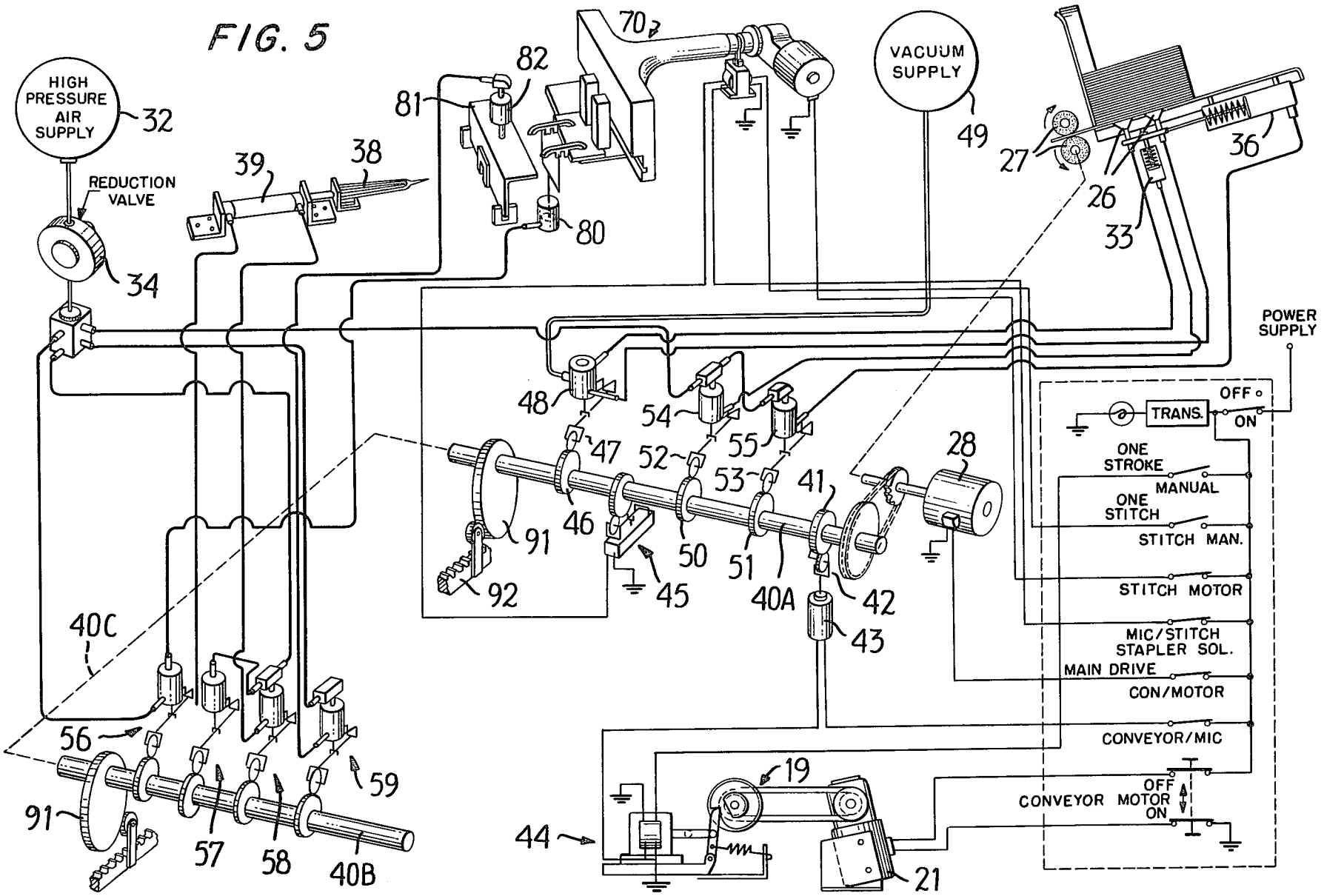
FIG. 5 is a schematic representation of the control mechanisms for the illustrative embodiment of the invention.

A pneumatic cylinder 39 has a wedge-shaped blade 38 connected to its piston rod. The blade 38 can be made to transverse the coupon holder 61 both toward and away from the conveyor by the application of air pressure from reducing valve 34 (FIG. 5). In particular the actuation of a pneumatic switching arrangement 57 moves the blade toward the conveyor and the actuation of pneumatic switching arrangement 58 moves it away from the conveyor.

The height of the blade 38 with respect to the stack of coupons in holder 61 is adjustable so that the thickness of one pack of take-one coupons to be stripped from the bottom of the stack can be set. The blade 38 may be pointed or flat and may be resilient or not, as desired.

A pneumatically operated L-shaped gate 81 is controlled by pneumatic switching arrangement 59, shown in FIG. 5. The gate 81 moves in a vertical direction toward and away from the conveyor under the influence of piston-cylinder 82.

The pneumatically fired staple gun of sticher 70 is preferably mounted approximately across the conveyor from the coupon holder 61. The stapler is the type which automatically cuts and forms the staples to be used in the course of its operation from a spool of wire. The staple inserters 75 are fixed in position above the conveyor, except for vertical movement up and down with respect to the items to be stapled on the conveyor. A suitable staple anvil 79 is similarly located beneath the conveyor.

When the apparatus is in operation the motors 21 and 28 are turned on by the switches shown in FIG. 5. Various special operations can be performed by setting the switches in various positions to add versatility to the overall system. The motor 21 drives the flight chain 16, except when it is interrupted by the activation of clutch 44. All of the timing of the operations of the various parts of th apparatus is controlled by the cam shafts 40A and 40B and their associated cams. These cam shafts are driven by motor 28 which also supplies the power for the nip rollers 27 of the feed mechanism and the carriage assembly of the coupon insertion station.

At the time when a panel is moved into the insertion station 60 by chain 16, the blade 38 and the arms 71–74 are in their leftmost position (not shown) as viewed in FIG. 4. Then the activation of pneumatic cylinder 39 causes the blade 38 to move the the right. The blade penetrates the stack of coupons in holder 61 and seperates a selected pack of them from the rest of the stack. Because of the wedge shape of the blade the top part of the stack is raised, creating a space between the selected pack and the rest of the stack. The stack does not move when the blade is inserted because gate 81 is in the down position.

The assembly support frame 96, under the influence of motor 28, then moves the arms 71–74 toward the selected pack of coupons while piston 80 acts on rocker arms 73 and 74 causing them to pivot counterclockwise as viewed in FIG. 4. A vertical pushing surface 84 located beneath the arms 73 and 74 is thereby permitted to engage the adjacent edge of the selected coupon stack. Gate 81 is then opened by pneumatic cylinder 82 so the selected coupons can be carried to the panel. While this is going on the blade 38 is retracted by pneumatic cylinder 39 and the stack of coupons drops down onto the tops of the carriage and rocker arms, which are designed to have smooth surfaces to prevent binding as the carriage and rocker arms move. The support frame 96 is moved to the right in FIG. 4 and the selected coupons are pushed into position on top of a waiting plate 83. Piston 80 then causes the raised rocker arms to close on top of the coupons holding them securely.

When a coupon pack has been moved into position in overlying registry with the support panel so that the ends of the pack are adjacent the anvil 79, a triggering mechaanism 45 (FIG. 5) causes the staple inserters 75 to move downwardly against the pack and to staple the pack to the support panel. Thereafter, the staple inserters move upwardly away from the assembled panel. Pneumatic cylinder 80 then causes rocker arms 73 and 74 to release the coupons and the assembly is returned to its leftmost position (not shown) as viewed in FIG. 4. Once the arms have cleared gate 81 it is lowered in preparation for the next operation and chain 16 moves the completed panel away from the coupon insertion station while a new panel is moved into the coupon insertion station. As soon as the rocker arms 73 and 74 have cleared the stack of coupons, the coupons fall onto the frame 76 until the next operation. Once the new panel is in place the chain 16 halts and the entire cycle repeats itself for the new panel.

The plate 83 is fixed to the side of the conveyor. It has upwardly flared end facing toward the incoming panels on the conveyor so that the panels move under the plate and into position to receive the staples. The purpose of the plate is to permit the selected coupons to ride without binding onto the top of the panels.

In a modification of the present invention the plate 83 is attached to the coupon support frame 96 and moves with the carriage arms 71 and 72 and the rocker arms 73 and 74 so that a pack of coupons can be gripped between the rocker arms and the plate 83 and then moved into stapling postion.

While the invention has been particularly shown and described with reference to a preferred embodiment thereof, it will be understood by those skilled in the art that various changes in form and details may be made therein without departing from the spirit and scope of the invention.

I claim:

1. Apparatus for assembling "take-one" coupons to a support panel comprising:

means for moving said panel along a defined path and for stopping said panel at a predetermined point on said path;

means for separating a preset number of "take-one" coupons from a stack of said coupons in order to form a pack of coupons, said means for separating including a wedge-shape blade, means for moving the blade along a second defined path into the stack of coupons at a height sufficient to separate the preset number of coupons from the bottom of the stack, and a displaceable gate member for bracing the preset number of coupons as the blade is moving into the stack, said gate being movable out of the path of the blade to permit the coupons to be moved into registry with said panel;

means for moving said preset number of "take-one" coupons to a position in overlying registry with said panel when said panel is at the predetermined point;

means for fastening said preset number of coupons to said panel in a manner permitting ready manual removal of individual ones thereof; and means for synchronizing the operation of said coupon moving and fastening means with each other and with said means for moving said panels to enable assembly of said coupons to said support panel in desired registration.

2. Apparatus as claimed in claim 1 wherein said means for moving said panel comprises:

a flight belt with extending lugs, said belt being located along said defined path, said extending lugs being spaced farther apart than at least one plane dimension of said panel; and means for moving and stopping said flight belt under the control of said means for synchronizing.

3. Apparatus as claimed in claim 1 wherein the stack of coupons is braced by a coupon holder assembly having a front wall on a front side of the stack adjacent the panel path and side walls on both sides of the stack adjoining the front side, the back side of the stack being opposite the front side, the displaceable gate comprises a lower portion of the front wall of the coupon holder, and the blade moves from the back of the stack toward the displaceable gate member.

4. Apparatus as claimed in claim 1 wherein said means for moving said preset number of coupons comprises :

at least one displaceable rocker arm whose longitudinal axis is generally perpendicular to the path of said panel, a supporting plate on which the stack of coupons may rest, means for moving said rocker arm in a direction along the axis of said rocker arms and through the region of the bottom of the stack of coupons toward the path of said panel so as to push the preset number of coupons across said supporting plate to the panel path, means for pivoting the end of the rocker arm closest to the panel path away from the supporting plate so that the rocker arm can be moved to a position where the preset number of coupons are between the rocker arm and the supporting plate and for pivoting the end of the rocker arm toward the supporting surface to hold the preset coupons together in a pack between the rocker arm and the plate.

5. Apparatus as claimed in claim 4 further including at least one carriage arm located closely adjacent and in line with said rocker arm on the end of the rocker arm remote from the path of said panel, said carriage arm and said rocker arm having smooth upper surfaces for supporting the bottom of the stack of coupons while said preset number of coupons is moved into registry with said panel.

6. Apparatus as claimed in claim 4 further including a flange moving with and located beneath said rocker arm and having said rocker arm pivotally connected to it, thereby allowing the present number of coupons to be gripped between the rocker arm and flange while the coupons are moved to the panel path.

7. Apparatus as claimed in claim 1 wherein said means for fastening comprise a pneumatically operated staple gun controlled by said means for synchronizing.

8. Apparatus as claimed in claim 1 wherein said means for synchronizing comprise, a main motor connected to a cam shaft, a plurality of cams along said cam shaft, and cam actuated switches for controlling said panel moving means said coupon moving and fastening means.

* * * * *

UNITED STATES PATENT AND TRADEMARK OFFICE

CERTIFICATE OF CORRECTION

PATENT NO. : 4,068,835

DATED : January 17, 1978

INVENTOR(S) : Allen A. Bortner

It is certified that error appears in the above-identified patent and that said Letters Patent are hereby corrected as shown below:

Col. 2, line 41, "present number" should read --preset number--;
line 51, after "chain" insert --16--;
line 52, "protion" should be --portion--;
Col. 3, line 13, "by means or" should read --by means of--;
Col. 4, line 11, "pneumation" should be --pneumatic--;
line 13, after "which" insert --is--;
lines 29 and 30, "accomodating" should read --accommodating--;
line 35, "rockers" should be --rocker--;
line 57, "transverse" should read --traverse--;
Col. 5, line 6, "of sticher" should read --or stitcher--;
line 23, "th" should read --the--;
line 32, "move the the" should be --move to the--;
lines 33 and 34, "seperates" should be --separates--;
line 61, "mechaanism" should be --mechanism--;
Col. 6, line 9, after "has" insert --an--;
line 20, "postion" should read --position--;
Col. 8, line 14, "present" should read --preset--; and
line 25, after "moving means" insert --and--.

Signed and Sealed this

Sixteenth Day of May 1978

[SEAL]

Attest:

RUTH C. MASON
Attesting Officer

LUTRELLE F. PARKER
Acting Commissioner of Patents and Trademarks